US011470697B2

(12) United States Patent
Rosado

(10) Patent No.: US 11,470,697 B2
(45) Date of Patent: Oct. 11, 2022

(54) AUTOSENSING DIMMER FOR LIGHT-EMITTING DIODES

(71) Applicant: Boca Flasher, Inc., Deerfield Beach, FL (US)

(72) Inventor: Luis Rosado, Miramar, FL (US)

(73) Assignee: Boca Flasher, Inc., Deerfield Beach, FL (US)

( * ) Notice: Subject to any disclaimer, the term of this patent is extended or adjusted under 35 U.S.C. 154(b) by 50 days.

(21) Appl. No.: 17/021,664

(22) Filed: Sep. 15, 2020

(65) Prior Publication Data

US 2022/0086977 A1 Mar. 17, 2022

(51) Int. Cl.
*H05B 45/10* (2020.01)
*H05B 45/325* (2020.01)
*H05B 45/14* (2020.01)

(52) U.S. Cl.
CPC ..... *H05B 45/14* (2020.01); *H05B 45/325* (2020.01)

(58) Field of Classification Search
CPC ..... H05B 45/00; H05B 45/10; H05B 45/14; H05B 45/30; H05B 45/325; H05B 39/048; H05B 41/36; H05B 41/38; H05B 41/3924; H05B 45/31; H05B 47/17
See application file for complete search history.

(56) References Cited

U.S. PATENT DOCUMENTS 8,085,160 B2 * 12/2011 Vanderzon ..... H05B 39/048 340/657
8,933,642 B2 * 1/2015 Ghanem ..... H05B 45/3725 315/276
9,489,005 B2 * 11/2016 Hausman, Jr. ..... H02M 5/297
10,080,273 B1 * 9/2018 Slivka ..... H02M 1/32
2019/0174593 A1 * 6/2019 Zhang ..... H05B 47/16

* cited by examiner

*Primary Examiner* — Thai Pham
(74) *Attorney, Agent, or Firm* — John J. Yim

(57) ABSTRACT

Disclosed is an electrical dimmer that upon activation sends a forward-phase modulated test power pulse to a connected load, receives from the load a response pulse, compares the width of the two pulses, and, depending upon the results of the comparison, operates in either forward- or reverse-phase modulation. The dimmer may respond to an intensity target by setting a pulse-width modulation duty cycle, the setting based on an intensity-translation curve. The translation curve may be based on a mapping between luminance and human visual perception of brightness. Some dimmers support a minimum intensity setting, and some dimmers configure themselves to the frequency of the incoming alternating-current power source.

21 Claims, 14 Drawing Sheets

500

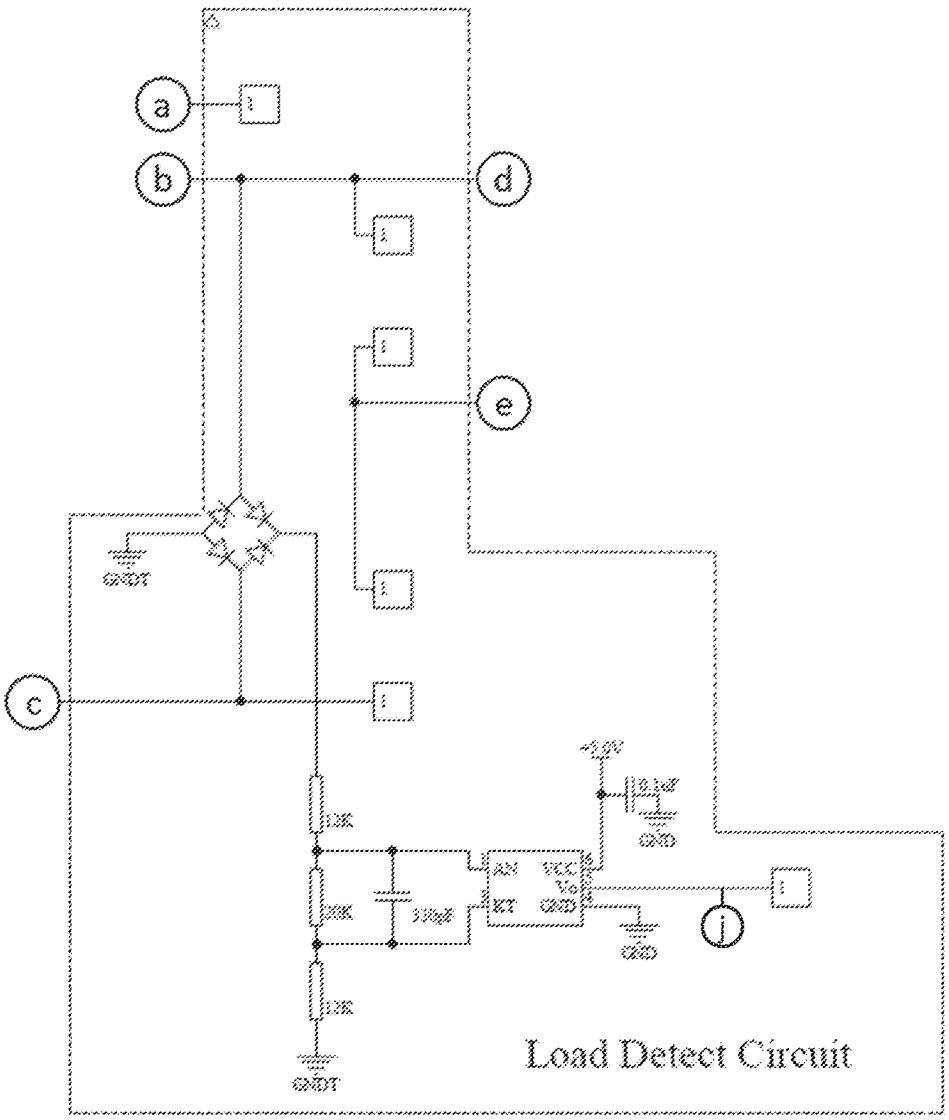
Load Detect Circuit
a
b
c
d
e
1
2
3
4
5
6
7
8
9
10
11
12
13
14
15
16
17
18
19
20
21
22
23
24
25
26
27
28
29
30
31
32
33
34
35
36
37
38
39
40

504

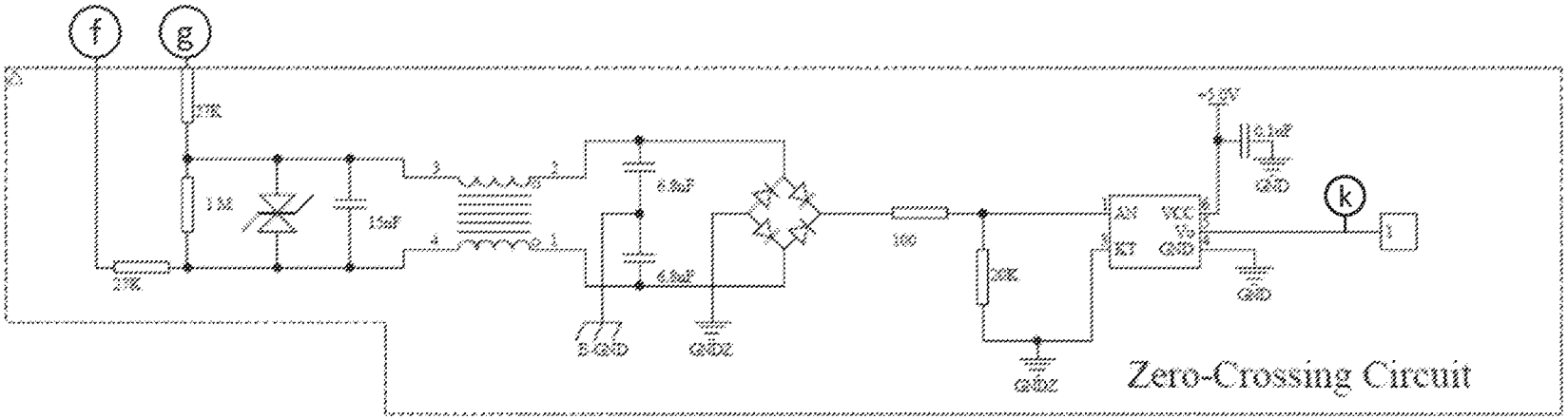
Zero-Crossing Circuit
506
f
g
k
1MΩ
1MΩ
1MΩ
1μF
1MΩ
100
100K
GND
+12V
0.1μF
GND
GND
GND

700

800

AUTOSENSING DIMMER FOR LIGHT-EMITTING DIODES

BACKGROUND

Field of the Invention

The present disclosure is related generally to electrical devices and, more particularly, to dimmers for light-emitting diodes ("LEDs").

Description of the Related Art

This section introduces aspects that may help facilitate a better understanding of the invention. Accordingly, the statements of this section are to be read in this light and are not to be understood as admissions about what is prior art or what is not prior art.

Dimmers modulate the amount of power reaching an electrical load such as a lamp or an electric motor. When the input power source is an alternating current ("AC") power line, the dimmer applies pulse-width modulation ("PWM") by entirely "blocking" the power for a portion of each cycle of the AC input. For the non-blocked portion of the AC cycle, the full electrical power is allowed through. By altering the portion of time that the input power is allowed through (called the "duty cycle"), the dimmer determines how much power reaches the load.

Some dimmers block the leading portion of each half cycle of the AC input power and are thus called "leading-edge" or "forward-phase" modulators. Others block the trailing edge ("trailing-edge" or "reverse-phase"). The modulation type used depends upon characteristics of the load.

Triodes for alternating current ("TRIACs") can be used in forward-phase dimmers, but they can cause a current overshoot that requires additional circuitry for suppression. TRIACs can also cause flicker, but for some loads, such as incandescent lamps, the flicker is hidden by the load's naturally slow response to voltage changes.

However, LEDs respond so quickly to voltage changes that when dimmed by traditional TRIAC dimmers their output noticeably and annoyingly flickers. To avoid flicker, some dimmers for LEDs now include extra circuitry to suppress TRIAC flicker, others implement reverse-phase modulation with a metal-oxide-semiconductor field-effect transistor (MOSFET) or an insulated-gate bipolar transistor ("IGBT"). However, some low voltage LEDs use inductive transformers, and reverse-phase modulation cannot be used with an inductive load because of the danger of a high reverse voltage that could damage both the dimmer and the load.

BRIEF SUMMARY

According to aspects of the present disclosure, upon activation a dimmer sends a forward-phase modulated test power pulse to a connected load, receives from the load a response pulse, compares the width of the two pulses, and, depending upon the results of the comparison, performs either forward- or reverse-phase modulation.

In certain embodiments, the dimmer responds to an intensity target by setting a PWM duty cycle, the setting based on an intensity-translation curve. The translation curve may be based on a mapping between luminance and human visual perception of brightness. Some embodiments support a minimum intensity setting.

Some embodiments configure themselves to the frequency of the incoming AC power source.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

FIGS. 5A, 5B, 5C, 5D, and 5E together show a circuit schematic for a power-supply circuit board in the exemplary dimmer of FIG. 3;

FIG. 5A is a key showing the connections of the circuits of FIGS. 5B, 5C, 5D, and 5E;

FIG. 5B is a schematic of an isolated bidirectional switch and TRIAC circuit;

FIG. 5C is a schematic of a load-detect circuit;

FIG. 5D is a schematic of a low voltage power supply circuit;

FIG. 5E is a schematic of a zero-crossing circuit;

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

Figure 1A:
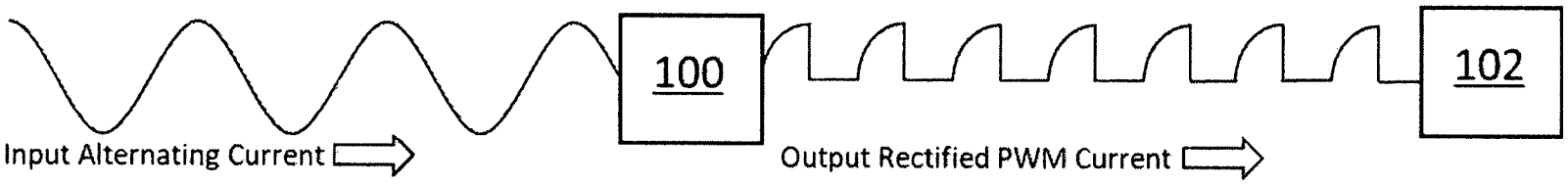
FIG. 1A illustrates a dimmer using reverse-phase modulation to control an electric device.
Figure 1B:
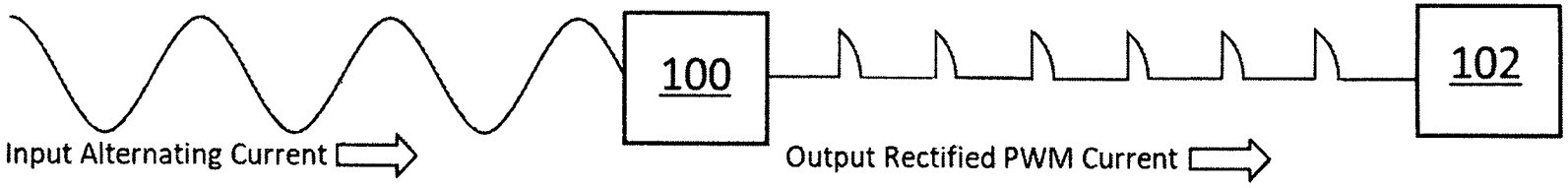
FIG. 1B is similar to FIG. 1A but shows forward-phase modulation.

To understand PWM, consider FIGS. 1A and 1B. On the left side of each figure is an input alternating current. The current's voltage sinusoidally varies from a "peak" of positive voltage, down through zero voltage, down further to a "valley" of negative voltage, rises up to another peak of positive voltage, and repeats indefinitely. In the United States, for example, typical "house current" voltage ranges between +/−120 volts with a period of 60 Hz. Other voltage ranges and frequencies are used in other applications: An adaptable dimmer 100, for example, may be built to work with maximum input voltages ranging from 120 to 227 volts and with frequencies from 50 to 60 Hz.

The dimmer 100 takes the incoming current and rectifies it, so that each valley of negative voltage in the input current is mirrored through the horizontal axis to become another positive peak. In some embodiments, the fully rectified current is used internally in the dimmer 100 for the low voltage power supply and for the zero-crossing pulse (see FIGS. 5D and 5E). Also, to provide the actual dimming function, the dimmer 100 applies PWM to reduce the amount of electrical power sent to the load 102 by interrupting the periodic power peaks. In FIG. 1A, the output voltage rises from zero at the beginning of each peak but is blocked or cut off down to zero voltage right about when the voltage reaches its highest value. This results in the load 102 receiving only about half the power of the original input current. Because the latter part of the peak is cut off, the PWM shown in FIG. 1A is called "reverse phase" modulation.

Alternately, the dimmer 100 may block the initial portion of each peak as shown in FIG. 1B. This is called "forward phase" modulation. By modifying exactly how much of each peak is blocked in each rectified cycle, the dimmer 100 controls how much power reaches the load 102. The choice between using forward- and reverse-phase PWM is made depending upon characteristics of the load 102.

Figure 2A:
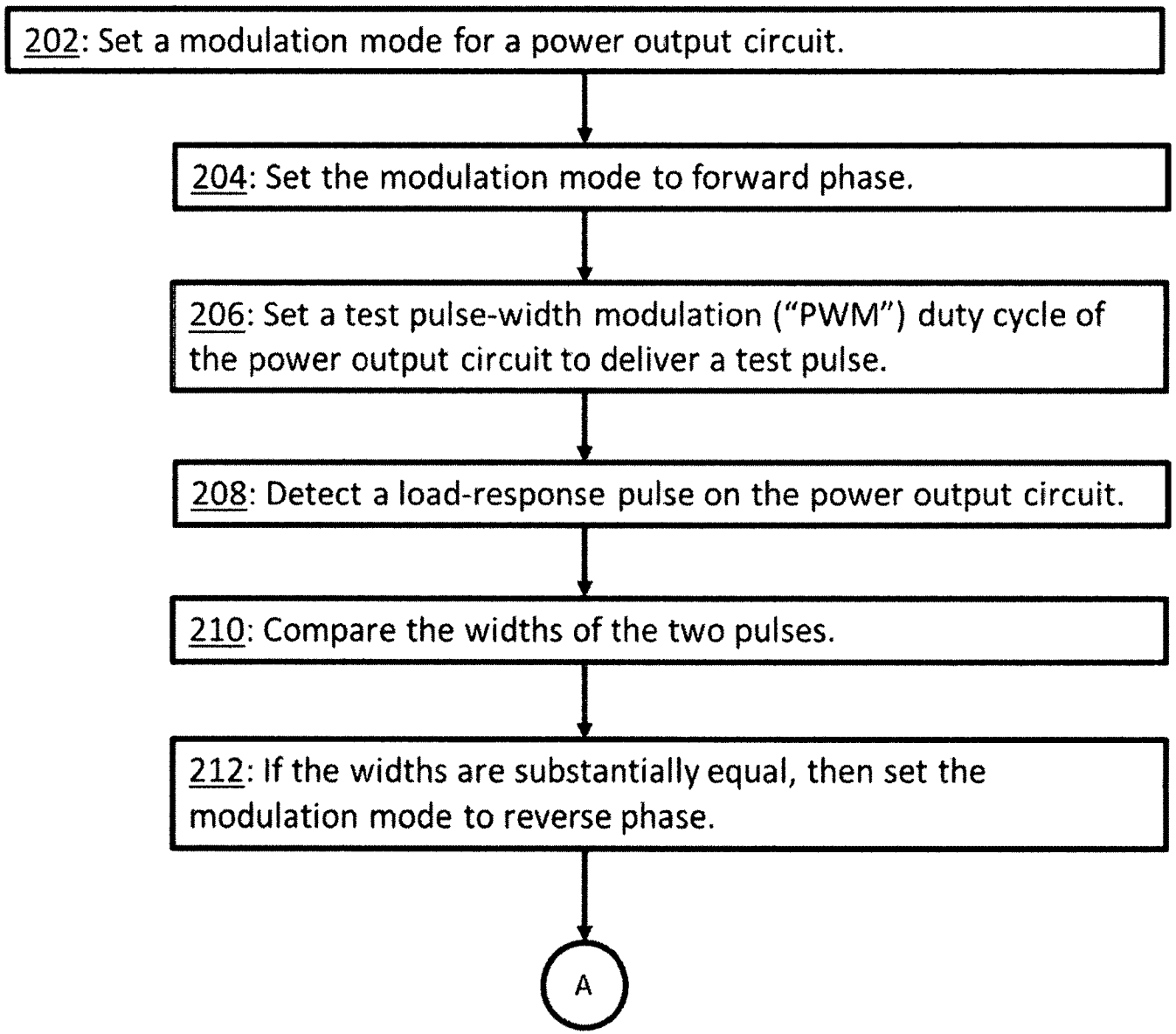
FIGS. 2A, 2B, and 2C together form an operational diagram according to certain aspects of the present disclosure.
Figure 2B:
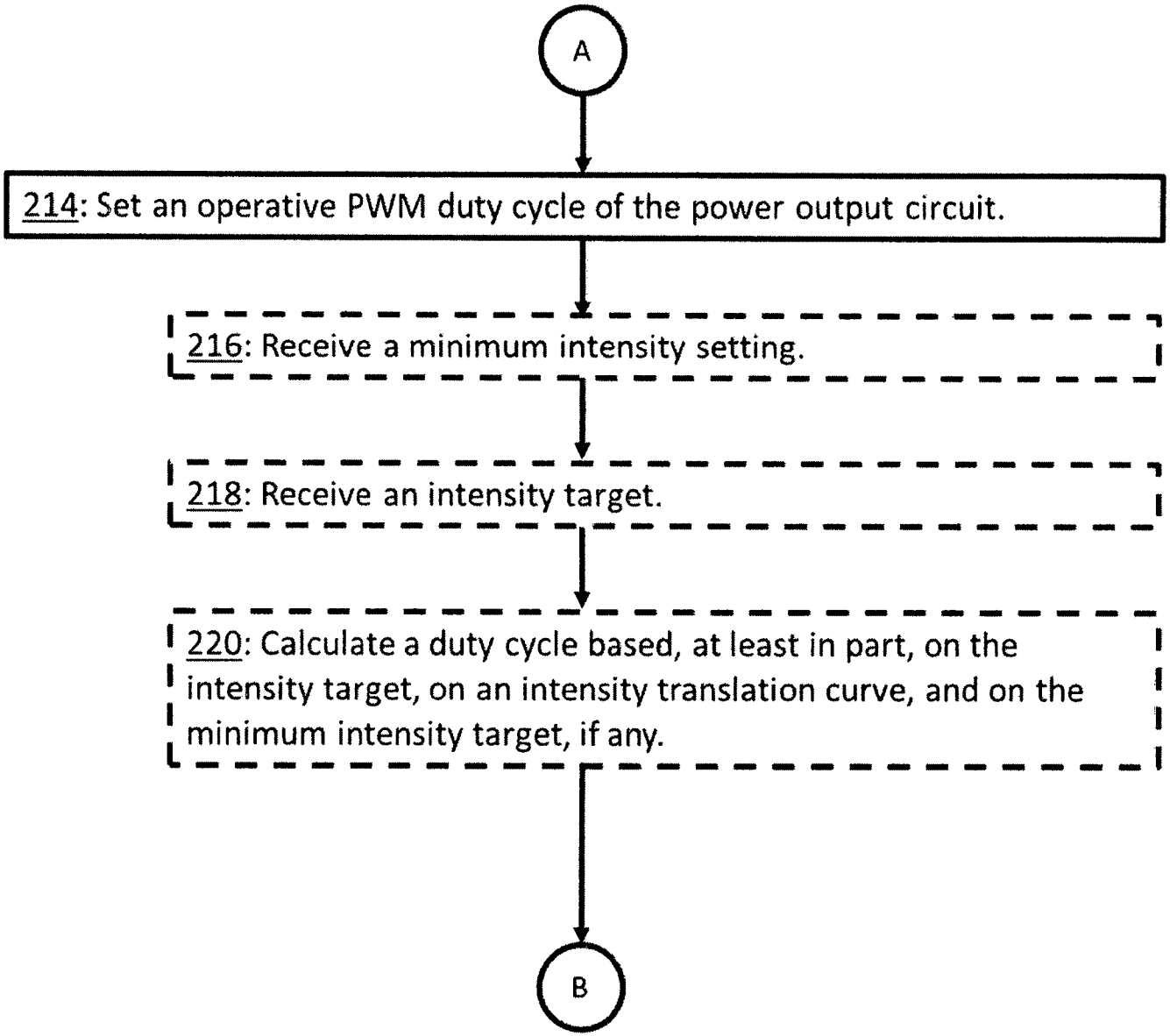
Figure 2C:
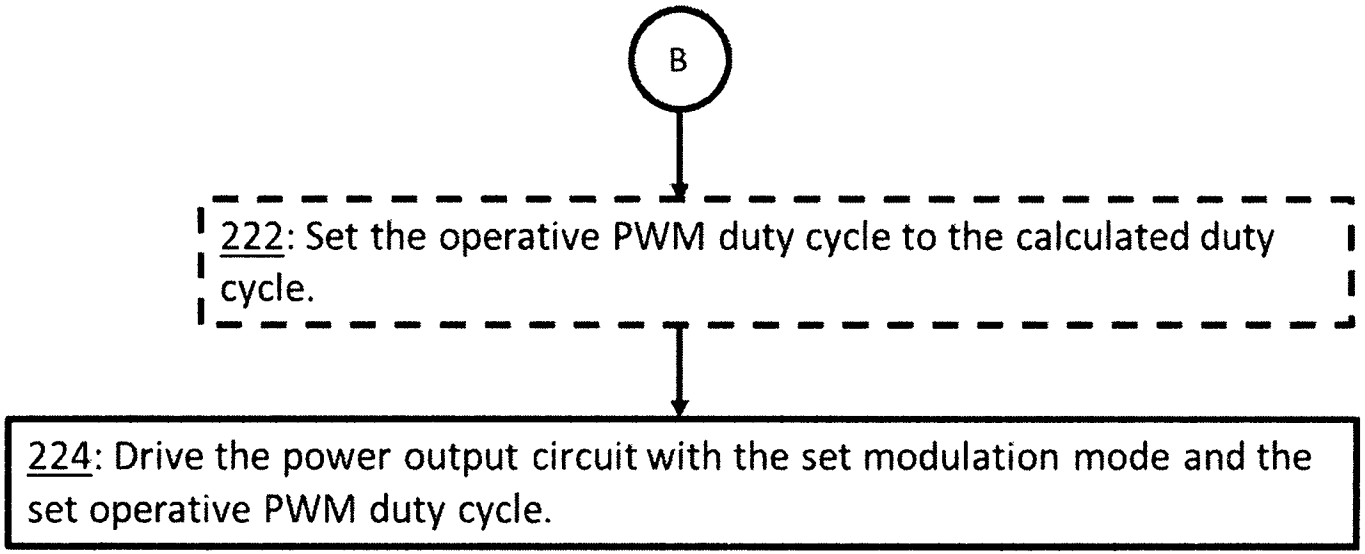

A dimmer 100, according to certain aspects of the present disclosure, may perform several "sub-tasks" that together constitute its primary task of providing a controllable amount of power to the load 102. These sub-tasks and their relationships are illustrated in FIGS. 2A, 2B, and 2C. Although these figures look like a flowchart, there is no limitation as to whether these sub-tasks are performed in hard-wired circuitry, in a microprocessor, or otherwise. Also, while described sequentially, many of these sub-tasks may be performed essentially simultaneously or, in some embodiments, not at all. In sum, FIGS. 2A, 2B, and 2C together show some of the operations that the dimmer 100 may perform, while further figures discussed below give examples of how a dimmer 100 can be designed to accomplish these operations.

The dimmer 100's task 200 is illustrated in FIG. 2A beginning with a first sub-task 202 of setting a power modulation mode for the output power circuit. The choices for the power modulation mode are the forward- and reverse-phase modulations as illustrated in FIGS. 1A and 1B.

In sub-task 204, an embodiment of the dimmer 100 sets the PWM mode to forward phase. Every time the voltage on the AC input line crosses zero, a "zero-crossing" pulse is generated. Driven by the zero-crossing pulse, and while in the forward phase, the dimmer 100 sets the PWM duty cycle of the output power circuit to send, in sub-task 206, one or more short-duration "test" power pulses to the load 102. In some embodiments, the PWM duty cycle is set to 1% (generally less than 5%) for sub-task 206.

In sub-task 208, the load 102 responds to the test pulse by creating a "load-response" pulse of its own that is detected by the dimmer 100. The width of the load-response pulse depends upon certain characteristics of the load 102.

In sub-task 210, the dimmer 100 compares the widths of the zero-crossing pulse and the load-response pulse to determine characteristics of the load 102. For example, in some embodiments: (i) If the load-response pulse is narrower than the zero-crossing pulse and occurs entirely within the duration of the zero-crossing pulse, then the dimmer 100 concludes that the load 102 is non-inductive. (ii) If the load-response pulse is wider than the zero-crossing pulse and begins during the duration of the zero-crossing pulse, then the load 102 is inductive. (iii) If the load-response pulse begins after the end of the zero-crossing pulse, then the load 102 is lightly loaded inductive.

Based on the results of the comparison in sub-task 210, the dimmer 100 may switch the PWM mode of its output from the forward phase set in sub-task 204 to reverse phase. In some embodiments, the switch to reverse phase is made when the widths of the zero-crossing and load-response pulses are substantially equal (that is, within 5% of one another).

Continuing the task 200, the dimmer 100 sets the duty cycle of its PWM output in sub-task 214 of FIG. 2B. In some embodiments, a minimum intensity setting is read in sub-task 216. This can be useful for coordinating the response of a large number of possibly diverse loads 102.

The desired or "target" intensity is read in sub-task 218, and an output PWM duty cycle is calculated in sub-task 220 to provide that target intensity. In some embodiments, a refinement is performed in sub-task 220. The outputs of some types of load 102 are not linear with respect to the input power they receive. Also, even if the load 102's output is linear with respect to its input, human perception of that output may not be linear. For example, human subjective perception of brightness is far from linear with respect to the actual, objective luminance emitted by a light. Sub-task 220 addresses these real or perceived non-linearities by running the target intensity through an "intensity-translation curve." If, for example, the target intensity setting for an LED 102 is doubled, then rather than simply doubling the amount of output power sent to the LED 102, the intensity translation curve ensures that the human subjective perception is that the LED 102's output brightness has doubled.

In sub-task 222 of FIG. 2C, the output PWM duty cycle is set based on the calculations of sub-task 220.

At this point, initialization of the dimmer 100 is complete. Having set the PWM mode to forward- or reverse-phase as is proper to the load 102 and having set the proper PWM duty cycle, the dimmer 100 now drives the load 102 accordingly in sub-task 224.

Not shown in task 200 is the ability of some dimmers 100 to detect the frequency of the incoming AC power and to then configure themselves to that frequency. This feature allows the dimmer 100 to be used throughout the world.

Figure 3:
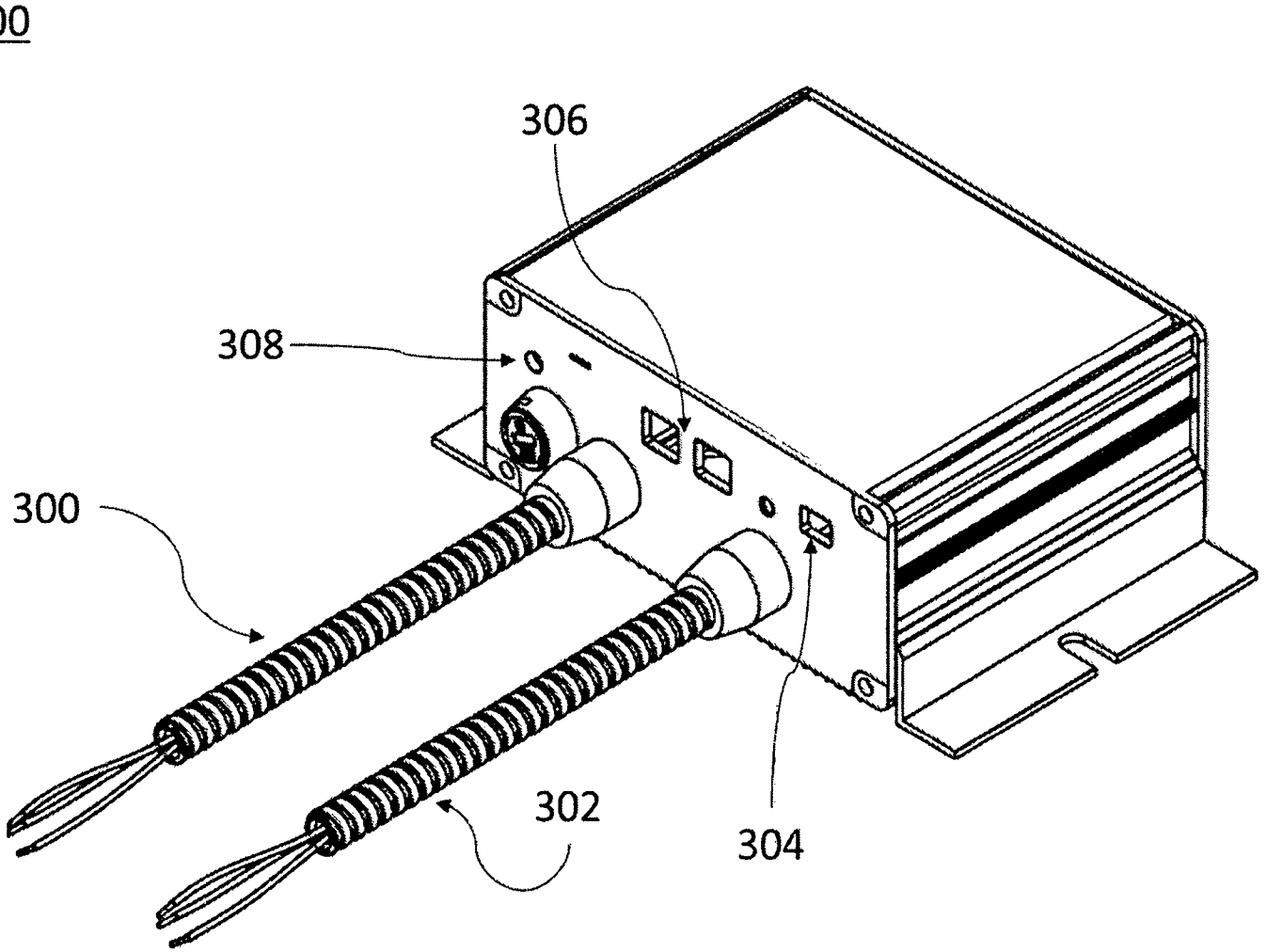
FIG. 3 is a perspective view of an exemplary dimmer made according to certain aspects of the present disclosure.

Considering now a physical embodiment of a dimmer 100, turn to the perspective view of FIG. 3. As many of the physical aspects of dimmers are well known to those of ordinary skill in the art, the present discussion only highlights a few of the more salient features. The dimmer 100 has a connection 300 to the input AC power line and an output power connection 302 to the load 102. An on/off switch is located at position 304. In some embodiments, two terminals for connecting to a 10 volt input circuit, used for setting an intensity target in sub-task 218 of FIG. 2B above, are located at position 306. A trim switch, used for setting a minimum intensity value in sub-task 216 of FIG. 2B above, is located at position 308. When the trim switch is pressed, the minimum intensity value is set to the current value of the intensity target.

Figure 4:
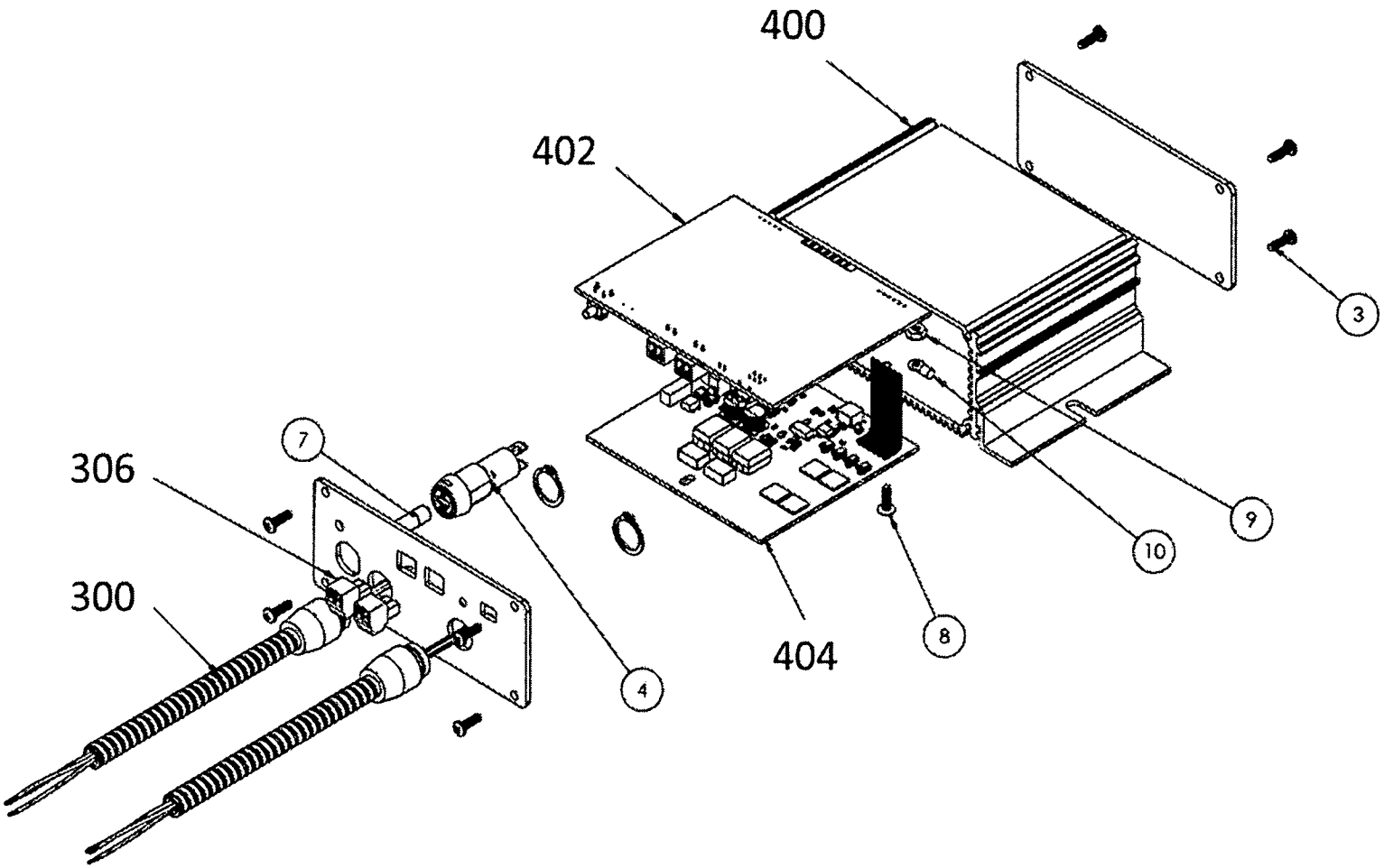
FIG. 4 is an exploded view of the exemplary dimmer of FIG. 3.

FIG. 4 "explodes" the dimmer 100 to show a few more physical details. The dimmer 100 includes a protective box 400. Housed within the box 400 are a "controller" printed circuit board ("PCB") 402 and a "supply" PCB 404. The remainder of this discussion is directed towards these two PCBs 402 and 404.

Figure 5A:
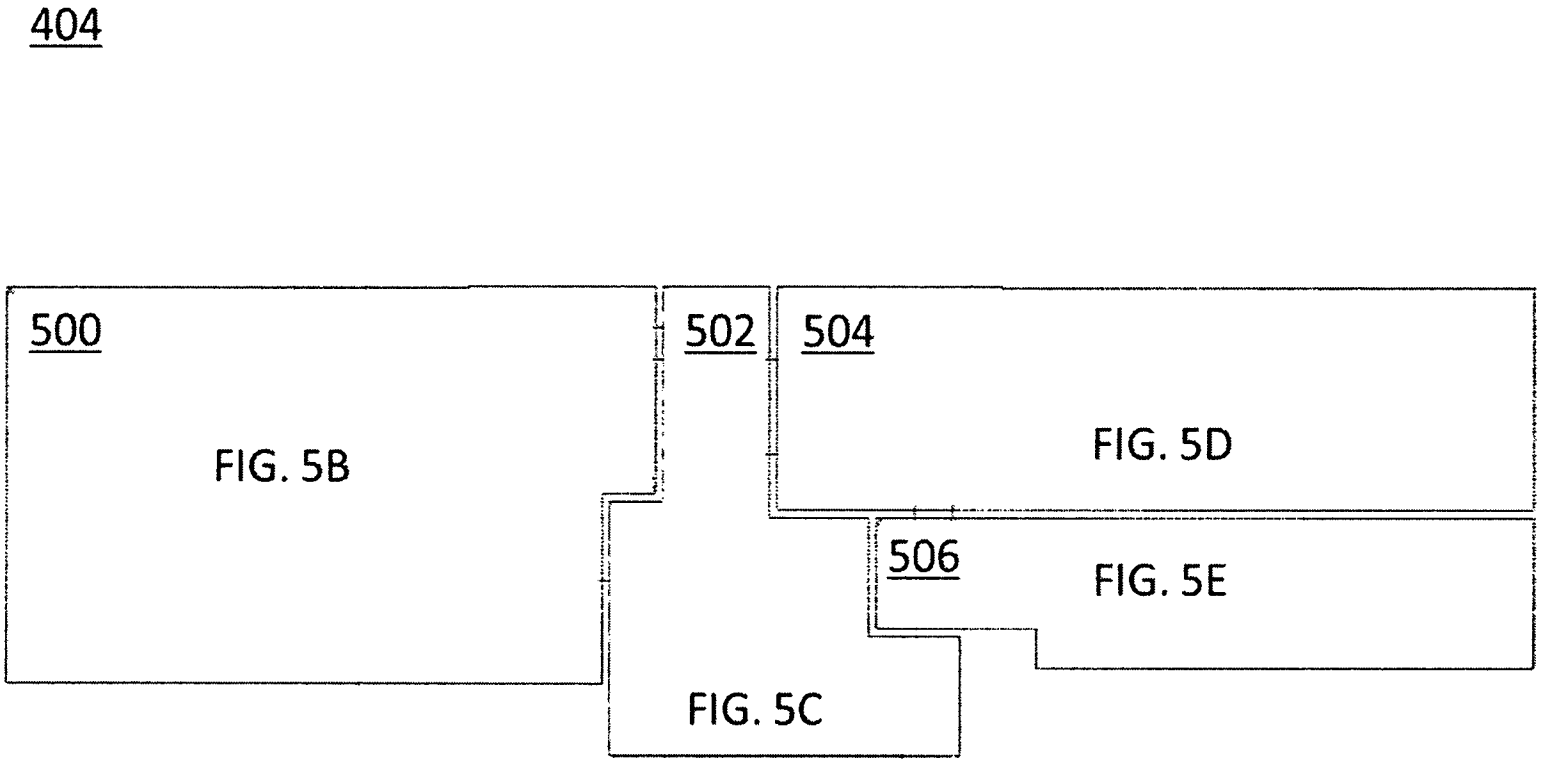
Figure 5B:
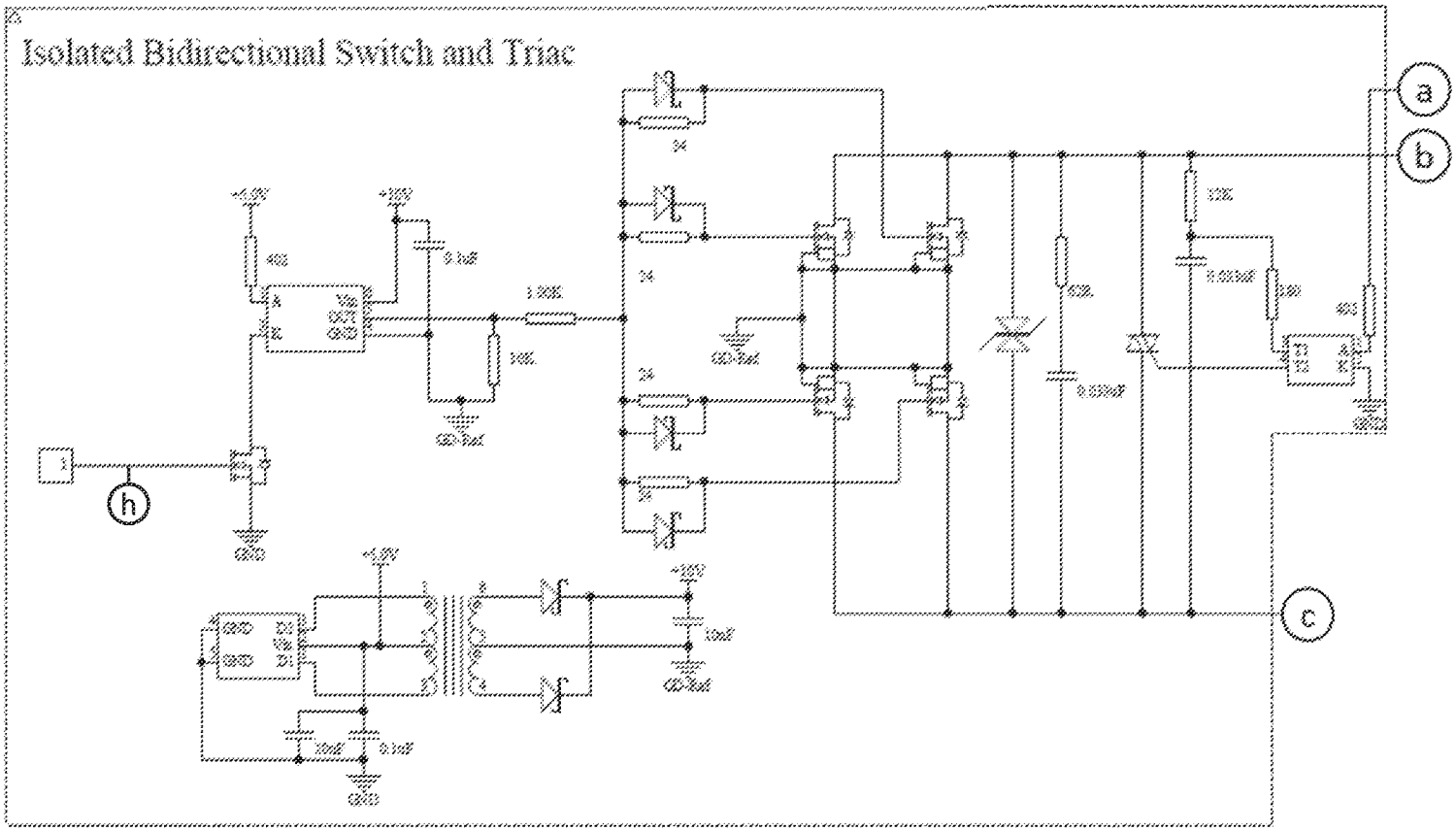
Figure 5D:
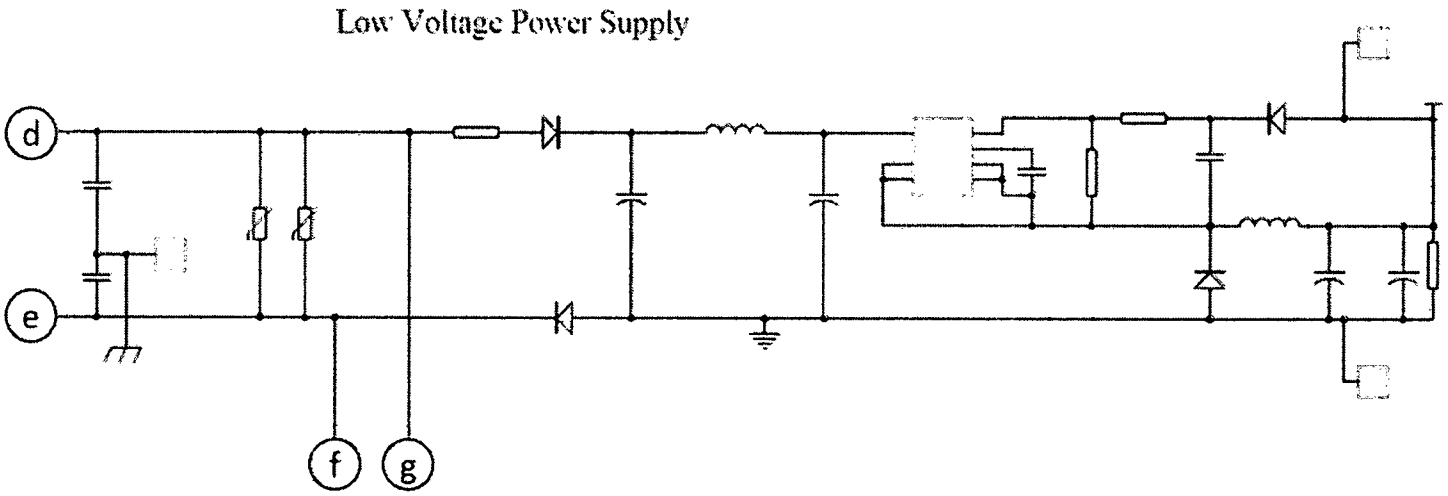

The supply PCB 404 is illustrated in FIGS. 5A, 5B, 5C, 5D, and 5E. In some embodiments, the supply PCB 404 includes an isolated bi-directional switch and TRIAC circuit (500 of FIG. 5B), a load-detect circuit (502 of FIG. 5C), a low voltage power supply (504 of FIG. 5D), and a zero-crossing circuit (506 of FIG. 5E). FIG. 5A is a key to show how the various circuits on the supply PCB 404 connect together. The isolated bi-directional switch and TRIAC circuit 500 of FIG. 5B is also referred to herein as the power output circuit. The low voltage power supply 504 of FIG. 5D is also referred to herein as the power input circuit.

Figure 6:
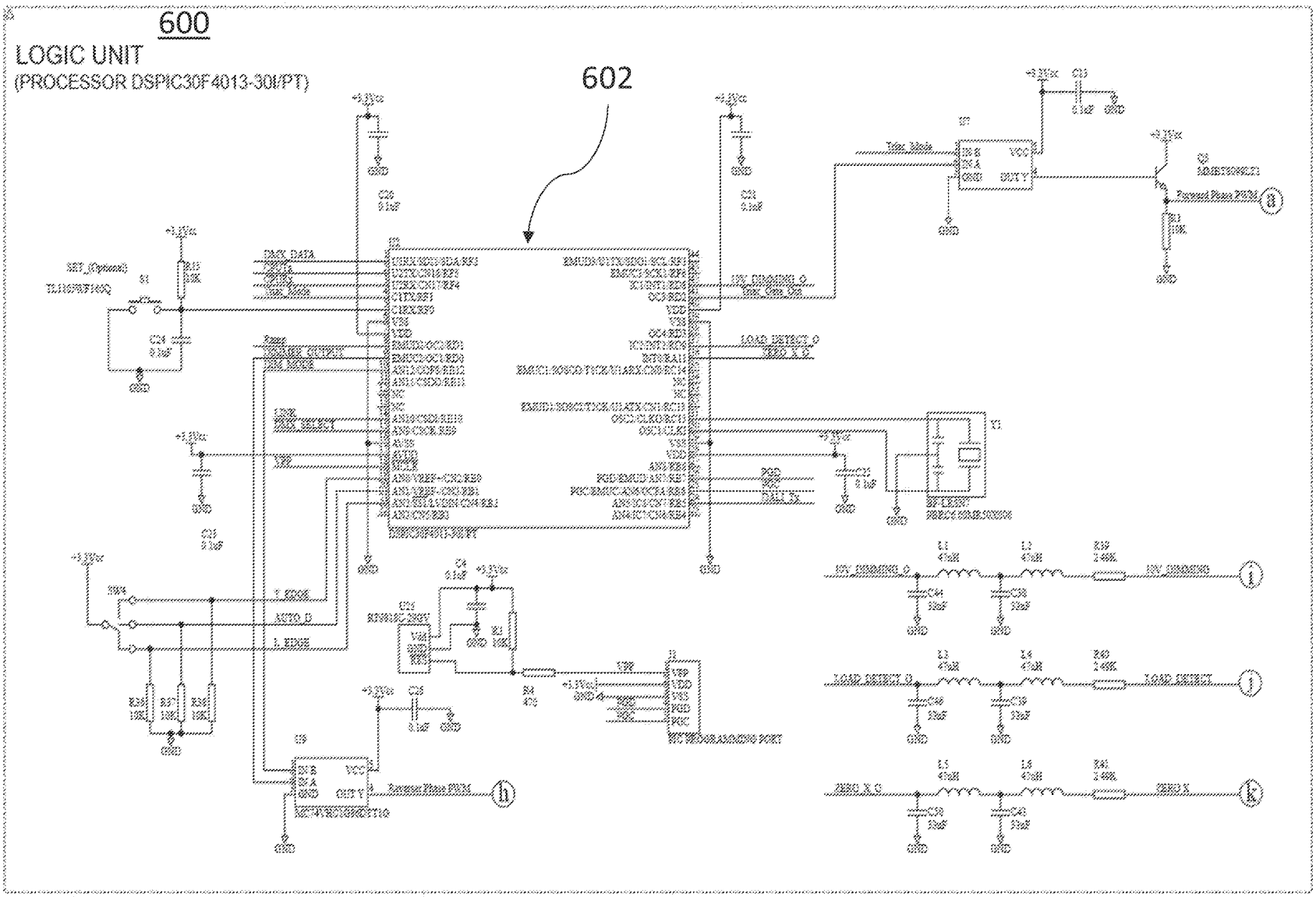
FIG. 6 is a schematic of a processor circuit than can be situated on a control circuit board of the exemplary dimmer of FIG. 3.
Figure 7:
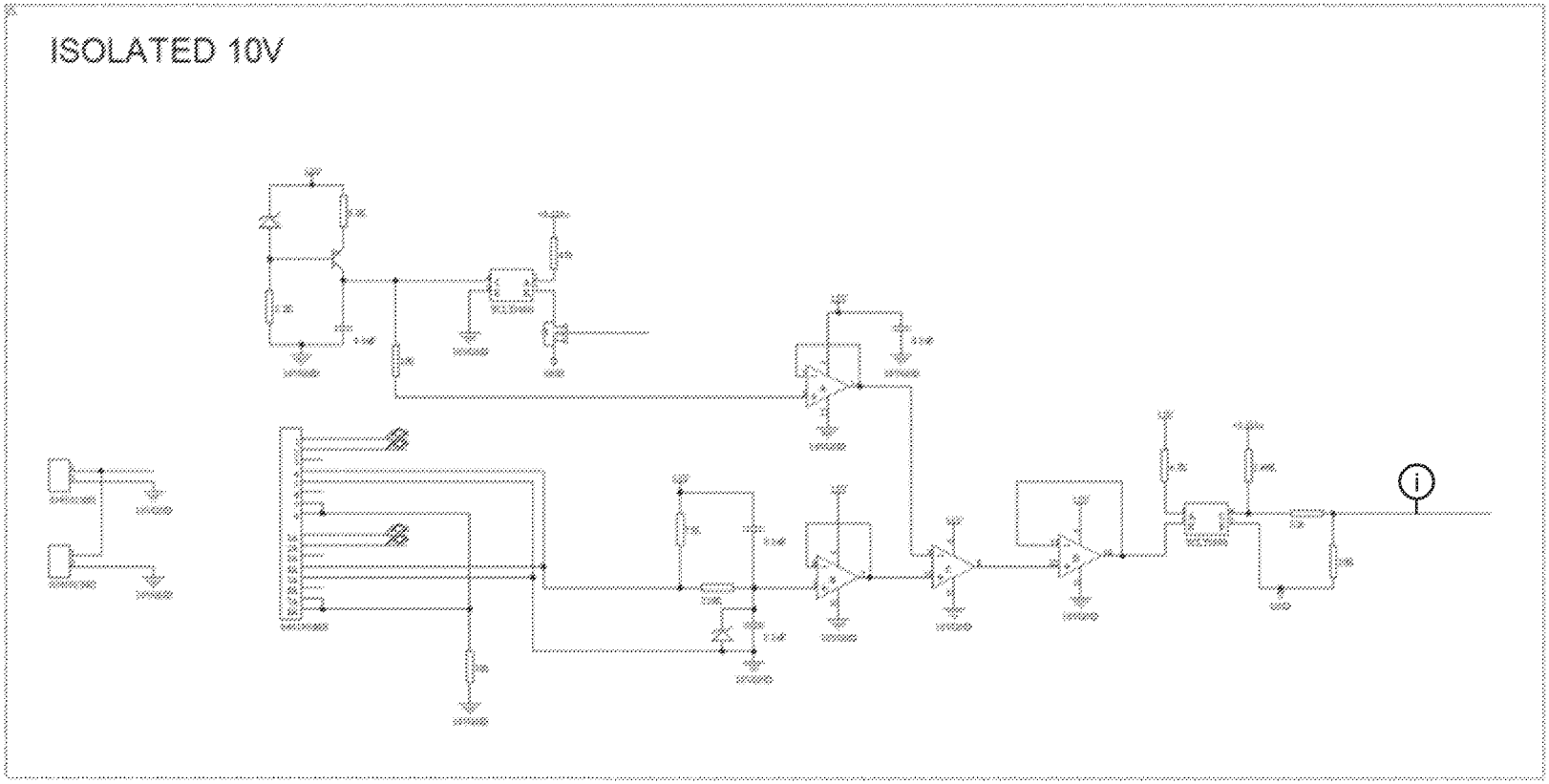
FIG. 7 is a schematic of an isolated 10 volt input circuit.
Figure 8:
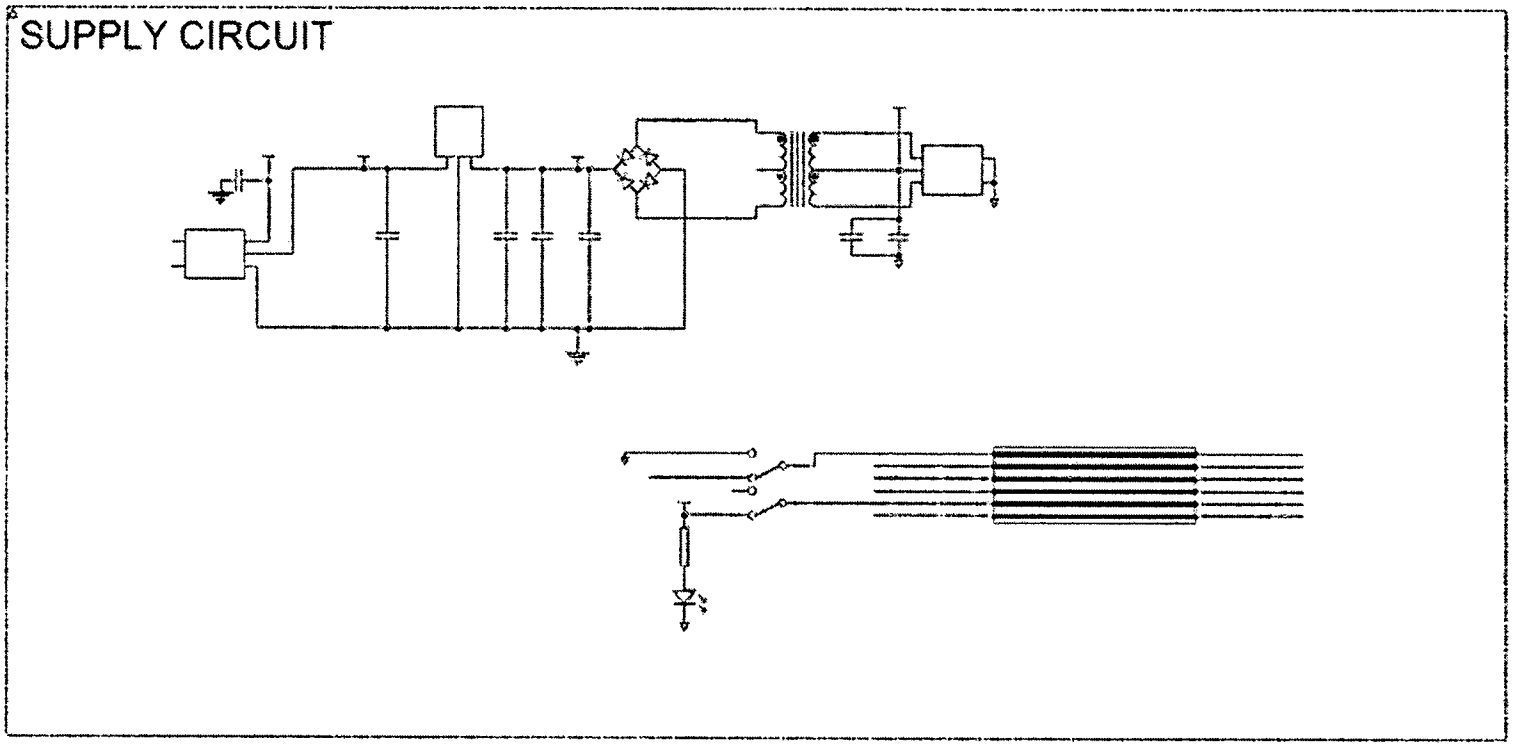
FIG. 8 is a schematic of an isolated supply for the 10 volt input circuit of FIG. 7.

The control PCB 402 is illustrated in FIGS. 6, 7, and 8. In some embodiments, the control PCB 402 includes a microprocessor circuit (600 of FIG. 6), an isolated 10 volt input circuit (700 of FIG. 7), and an isolated supply circuit (800 of FIG. 8). The microprocessor 602 serves as an example logic device, configured to interact with other circuits illustrated herein. The microprocessor 602 is also referred to herein as logic device, logic unit, and the like.

As with the physical details of dimmers, many of the electrical details shown on PCBs 402, 404 are known to those of ordinary skill in the art, so only a few operational points are discussed here, tied to the operational diagram of FIGS. 2A, 2B, and 2C.

The zero-crossing circuit 506 generates the 400 μsecond-wide zero-crossing pulse every time the voltage on the AC input line 300 crosses zero. During initialization, the microprocessor 602 responds to the zero-crossing interrupts and to an internal timer to measure the frequency of the AC input line 300 (e.g., 50 Hz or 60 Hz) and then to synchronize its operations to that frequency. The interrupts and timer are also used during initialization to adjust the PWM and set other timers.

Still during initialization, the microprocessor 602 sets the output mode to forward-phase and sets the PWM duty cycle to 1% (see sub-tasks 204, 206 of FIG. 2A). The load-detect circuit 502 generates a logic high (sub-task 208 of FIG. 2A) when the output switch (TRIAC or MOSFET) is closed (that is, when the load 102 is connected). From the timing of the load-detect circuit 502's signal, the microprocessor 602 determines whether the load 102 is inductive or not and sets the operational PWM accordingly (sub-tasks 210, 212 of FIG. 2A).

After initialization, the dimmer 100 enters normal operation (sub-task 224 of FIG. 2C). The microprocessor 602 uses two timers and two interrupts to synchronize all of its circuits. One timer controls the resolution (i.e., duty cycle) of the PWM, and the second timer controls the isolated 10 volt circuit 700. The interrupts are generated by the zero-crossing circuit 506 and by the isolated 10 volt circuit 700.

In sub-task 218 of FIG. 2C, the isolated 10 volt circuit 700 generates a PWM signal from the 10 volt control input 306. This circuit 700 receives a small pulse, synchronized with the zero-crossing pulse, to reset a sawtooth-ramp generator. The output of the ramp generator is compared with a voltage level from the 10 volt control signal using an operational amplifier. The comparison generates a PWM signal with a duty cycle proportional to the 10 volt control signal level. This PWM signal from the isolated 10 volt circuit is connected to an interrupt pin of the microprocessor 602. When the microprocessor 602 receives this signal (falling edge), the timer is read, and the value is used to determine the intensity level for the load 102 (sub-task 220 of FIG. 2B).

The second interrupt comes from the zero-crossing circuit 506. As mentioned above, the zero-crossing circuit 506 generates a pulse every time the AC input power line 300 crosses zero volts. When the microprocessor 602 receives the rising edge of the zero-crossing pulse, it generates an interrupt. During the interrupt-service routine, the primary timer and the 10 volt circuit timer are reset, and a value obtained from the isolated 10 volt circuit 700 is loaded into an intensity target variable (sub-task 218 of FIG. 28). The duty cycle of the PWM is changed by a small portion on every interrupt until its value matches the intensity target variable value. In some embodiments, there are 540 steps from intensity off to maximum intensity. This large number of steps yields a very smooth intensity transition.

It will be understood that various changes in the details, materials, and arrangements of the parts which have been described and illustrated in order to explain embodiments of this invention may be made by those skilled in the art without departing from embodiments of the invention encompassed by the following claims.

It should be understood that the sub-tasks of the exemplary methods set forth herein are not necessarily required to be performed in the order described, and the order of the sub-tasks of such methods should be understood to be merely exemplary. Likewise, additional sub-tasks may be included in such methods, and certain sub-tasks may be omitted or combined, in methods consistent with various embodiments of the invention.

In view of the many possible embodiments to which the principles of the present discussion may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

I claim:

1. A method for electrically powering a load, the method comprising:

setting, by a logic device, a modulation mode of a power output circuit operatively connected to the load, the setting comprising:

setting, by the logic device, the modulation mode of the power output circuit to forward phase;

setting, by the logic device, a test pulse-width modulation ("PWM") duty cycle of the power output circuit to deliver a test pulse at a zero-voltage crossing of an input alternating current ("AC") power source;

detecting, by the logic device, a load-response pulse on the power output circuit;

comparing, by the logic device, a width of the test pulse to a width of the load-response pulse; and if the width of the test pulse and the width of the load-response pulse are within 5% of one another, then setting the modulation mode of the power output circuit to reverse phase;

setting, by the logic device, an operative PWM duty cycle of the power output circuit; and driving, by the logic device, the power output circuit with the set modulation mode and the set operative PWM duty cycle.

2. The method for electrically powering a load of claim 1 wherein the test PWM duty cycle is less than 5%.

3. The method for electrically powering a load of claim 1 wherein setting an operative PWM duty cycle of the power output circuit comprises:

receiving, by the logic device, an intensity target;

calculating, by the logic device, a duty cycle, the calculating based, at least in part, on the received intensity target and on an intensity-translation curve; and setting, by the logic device, the operative PWM duty cycle to the calculated duty cycle.

4. The method for electrically powering a load of claim 3 further comprising:

receiving, by the logic device, a minimum intensity setting;

wherein the calculating is based, at least in part, on the received minimum intensity setting.

5. The method for electrically powering a load of claim 3 wherein the intensity-translation curve is digitized with more than one hundred steps.

6. The method for electrically powering a load of claim 3 wherein the intensity-translation curve is based, at least in part, on a mapping between luminance and human visual perception of brightness.

7. A dimmer adapted for providing a power to a load external to the dimmer, the dimmer comprising:

a power input circuit configured to be connected to an input alternating current ("AC") power source external to the dimmer;

a power output circuit configured to provide power to the external load;

and a logic device configured:

to set a modulation mode of the power output circuit, the setting comprising:

setting the modulation mode of the power output circuit to forward phase;

setting a test pulse-width modulation ("PWM") duty cycle of a PWM signal to deliver a test pulse at a zero-voltage crossing of the input AC power source;

detecting a load-response pulse on the power output circuit;

comparing a width of the test pulse to a width of the load-response pulse; and if the width of the test pulse and the width of the load-response pulse are within 5% of one another, then setting the modulation mode of the power output circuit to reverse phase;

to set an operative PWM duty cycle of the PWM signal; and to drive the power output circuit with the set modulation mode and the set operative PWM duty cycle.

8. The dimmer of claim 7 wherein the test PWM duty cycle is less than 5%.

9. The dimmer of claim 7:

further comprising a first control input circuit configured to receive an intensity target from a source external to the dimmer;

wherein the logic device is further configured:

to read the intensity target, to calculate a duty cycle, the calculating based, at least in part, on the intensity target and on an intensity-translation curve, and to set the operative PWM duty cycle of the PWM signal to the calculated duty cycle.

10. The dimmer of claim 9:

further comprising a second control input circuit configured to receive a minimum intensity setting from a source external to the dimmer;

wherein the logic device is further configured:

to read the minimum intensity setting and to calculate the duty cycle based, at least in part, on the minimum intensity setting.

11. The dimmer of claim 9 wherein the intensity-translation curve is digitized with more than one hundred steps.

12. The dimmer of claim 9 wherein the intensity-translation curve is based, at least in part, on a mapping between luminance and human visual perception of brightness.

13. The dimmer of claim 7 further comprising:

a frequency monitor operatively connected to the power input circuit, the frequency monitor configured for determining a frequency of the AC source and for reporting the determined frequency to the logic device.

14. A dimmer adapted for providing, under external control, an adjustable power to a load external to the dimmer, the dimmer comprising:

a power input circuit configured to be connected to an alternating current source external to the dimmer;

a power output circuit configured to provide power to the external load;

a first control input circuit configured to receive an intensity target from a source external to the dimmer; and a logic device configured:

to read the intensity target, to calculate a duty cycle, the calculating based, at least in part, on the intensity target and on an intensity-translation curve, and to set a duty cycle of a pulse-width modulated ("PWM") signal to the calculated duty cycle.

15. The dimmer of claim 14:

further comprising a second control input circuit configured to receive a minimum intensity setting from a source external to the dimmer;

wherein the logic device is further configured:

to read the minimum intensity setting and to calculate the duty cycle based, at least in part, on the minimum intensity setting.

16. The dimmer of claim 14 wherein the intensity-translation curve is digitized with more than one hundred steps.

17. The dimmer of claim 14 wherein the intensity-translation curve is based, at least in part, on a mapping between luminance and human visual perception of brightness.

18. The dimmer of claim 14 further comprising:

a frequency monitor operatively connected to the power input circuit, the frequency monitor configured for determining a frequency of the alternating current source and for reporting the determined frequency to the logic device.

19. A dimmer adapted for providing, under external control, an adjustable power to a load external to the dimmer, the dimmer comprising:

a power input circuit configured to be connected to an alternating current source external to the dimmer;

a power output circuit configured to provide power to the external load;

a first control input circuit configured to receive an intensity target from a source external to the dimmer;

a second control input circuit configured to receive a minimum intensity setting from a source external to the dimmer; and a logic device configured:

to read the intensity target, to read the minimum intensity setting and to calculate a duty cycle, the calculating based, at least in part, on the intensity target, on an intensity-translation curve, and on the minimum intensity setting, and to set a duty cycle of a pulse-width modulated ("PWM") signal to the calculated duty cycle.

20. The dimmer of claim 19 wherein the intensity-translation curve is digitized with more than one hundred steps.

21. The dimmer of claim 19 wherein the intensity-translation curve is based, at least in part, on a mapping between luminance and human visual perception of brightness.

* * * * *